US005254453A

United States Patent [19]

Chang

[11] Patent Number: 5,254,453

[45] Date of Patent: Oct. 19, 1993

[54] PROCESS FOR PREPARING NARROW SIZE DISTRIBUTION SMALL TABULAR GRAINS

[75] Inventor: Elizabeth U. Chang, Webster, N.Y.

[73] Assignee: Eastman Kodak Company, Rochester, N.Y.

[21] Appl. No.: 869,674

[22] Filed: Apr. 16, 1992

[51] Int. Cl.[5] ..... G03C 1/015

[52] U.S. Cl. ..... 430/569; 430/567

[58] Field of Search ..... 430/567, 569

[56] References Cited

U.S. PATENT DOCUMENTS

| | | | |
|---|---|---|---|
| 4,063,951 | 12/1977 | Bogg | 430/569 |
| 4,067,739 | 1/1978 | Lewis | 430/569 |
| 4,150,994 | 4/1979 | Maternaghan | 430/569 |
| 4,431,729 | 2/1984 | Falxa | 430/569 |
| 4,477,565 | 10/1984 | Himmelwright | 430/567 |
| 4,722,886 | 2/1988 | Nottorf | 430/567 |
| 4,801,522 | 1/1989 | Ellis | 430/569 |
| 5,013,641 | 5/1991 | Buntaine et al. | 430/567 |
| 5,087,555 | 2/1992 | Saitou | 430/567 |
| 5,096,806 | 3/1992 | Nakamura et al. | 430/567 |

FOREIGN PATENT DOCUMENTS

| | | |
|---|---|---|
| 1155325 | 10/1983 | Canada . |
| 0391560 | 10/1990 | European Pat. Off. . |
| 0410410 | 1/1991 | European Pat. Off. . |
| 258547 | 7/1988 | German Democratic Rep. . |
| 61-23148 | 1/1986 | Japan . |
| 1247697 | 9/1971 | United Kingdom . |
| 1469480 | 4/1977 | United Kingdom . |
| 2109577 | 6/1983 | United Kingdom . |

OTHER PUBLICATIONS

Carroll et al, Research Paper No. 376, "The Photographic Emulsion the Silver Ion Gelatin Equilibrium", p. 821.

Markocki et al, Photographic Science and Engineering, vol. 17, No. 3, 1973.

Scott, The British Journal of Photography, Feb. 25, 1983, p. 211.

Duffin, Photographic Emulsion Chemistry, 1966, p. 72.

Photographic Chemistry, vol. 1, 1957, p. 331.

Neblette, Photography Its Materials and Processes, p. 120.

Carroll et al, Introduction to Photographic Theory, 1980, p. 124.

Abstract of German Patent 2422320, Nov. 1975.

Abstract of German Patent 2932185, Feb. 1980.

Abstract of Japanese Patent 63-26651, Feb. 1988.

Abstract of Japanese Patent 61-23148, Jan. 1986.

*Primary Examiner*—Janet C. Baxter

*Attorney, Agent, or Firm*—Paul A. Leipold

[57] ABSTRACT

The invention is generally accomplished by a method of forming a silver halide emulsion in which digestion of nucleated silver halide grains is carried out in a halide solvent concentration of between about 0.0015 and about 0.015 normal. In a preferred embodiment the solvent utilized is ammonium hydroxide and grains of a thickness of between about 0.05 and 0.5 micron having an equivalent circular diameter of about 0.05 to about 2.0 microns are produced. It is also preferred that the grains be nucleated in a bromide solution having a bromide ion concentration of between 0.0075 and about 0.6 normal.

17 Claims, 1 Drawing Sheet

PROCESS FOR PREPARING NARROW SIZE DISTRIBUTION SMALL TABULAR GRAINS

TECHNICAL FIELD

This invention relates to methods of forming small tabular grains for photographic products and to emulsions containing such grains.

BACKGROUND ART

Published U.S. Pat. Nos. 4,434,048 and 4,434,226 set forth tabular emulsions. These emulsions comprise greater than 70 percent projected area of tabular grains. Most of the conditions which promote tabularity also lead to grain growth and polydispersed size distribution.

Using solvent to give narrow size distribution is discussed in many photographic books, such as Photographic Emulsion Chemistry by G. F. Duffin, 1966, or Introduction to Photographic Theory by B. H. Carroll et al, 1980. In tabular grain, using a large amount of solvent such as U.S. Pat. No. 4,722,886—Nottorf discloses narrow tabular grain size distribution, but Nottorf's process also promotes tabular grain increase in diameter and thickness. It is very difficult to grow small diameter tabular grains with little fine grain contamination, narrow tabular grain size distribution, and also maintain a relatively large aspect ratio for the tabular grains when using a large amount of solvent. Fine grains as a contaminate absorb sensitizing dye and incoming light but form little image. The fine grains also include 3D grains which scatter light and degrade sharpness. It is very desirable to reduce the presence of fine grain.

There is a continuing need to improve forming of tabular silver halide grains. There is a particular need to form more monodispersed emulsions. This is particularly difficult with tabular grains of a small equivalent circular. It has been difficult to produce grains of an equivalent circular diameter of between 0.5 and 2 microns without having a high percentage of fines of less than this size. It is also difficult to form such small grains that are thin with a large aspect ratio. Formation of such small grains is of interest, as they have particular utility for the lower speed layers of color negative films.

DISCLOSURE OF THE INVENTION

An object of the invention is to overcome disadvantages of prior emulsion-forming processes.

Another object of the invention is to produce emulsions that are monodispersed and of small grain size.

It is an object of the invention to produce emulsions having a high proportion of thin high aspect small tabular grains.

These and other objects of the invention are generally accomplished by a method of forming a silver halide emulsion in which digestion of nucleated silver halide grains is carried out in a basic silver halide solvent concentration of between about 0.0015 and about 0.015 normal. The basic solvent is neutralized after the digestion. In a preferred embodiment the solvent utilized is ammonium hydroxide and grains of a thickness of between about 0.05 and 0.5 micron having an equivalent circular diameter of about 0.02 to about 3.0 microns are produced. It is also preferred that the grains be nucleated in a bromide solution having a bromide ion concentration of between 0.0075 and about 0.6 normal.

MODES FOR CARRYING OUT THE INVENTION

Figure 2:
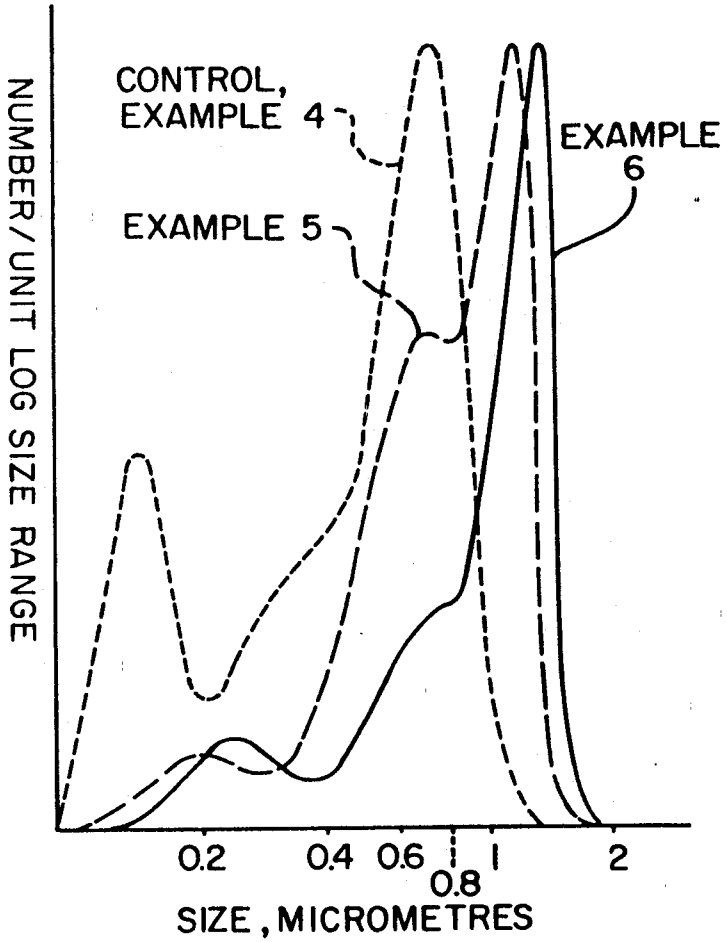
FIG. 2 is graphical representation of the size and number of grains produced by Examples 4–6.

The invention has numerous advantages over prior processes of forming emulsions and particularly small grain size tabular emulsions. Emulsions of the invention are more uniform having a lower coefficient of variation (COV) of less than 25. This lower COV means that the grains have a narrower size distribution and, therefore, have uniform properties.

Further, the emulsions of the invention have a lower percentage of fine grains. This results in better performance, as the fines do not contribute to photographic performance and cause deterioration of such performance. The process of forming the emulsions of the invention further has the advantage that it is a robust process, meaning that small variations in the invention process of digestion after nucleation do not result in a radically different product. Such robust emulsions are easier to manufacture reliably. These and other advantages will become apparent from the detailed description below.

The method of the invention is generally accomplished by the process steps indicated below.

The process for preparing a narrow size range of small tabular grain size photographic emulsion in accordance with the invention comprises a) Adding silver nitrate or both silver nitrate and halide(s) to the aqueous gelatin dispersing medium containing a bromide or bromide iodide mixture, initial bromide ion concentration is 0.0075 to 0.6N, and temperature is from 35 to 80 degrees when forming the nuclei.

b) When more than 0.1% and preferable more than 0.5 percent by weight of total silver halide is precipitated, a basic halide solvent, such as ammonia, or an ammoniacal solution is added to achieve 0.0015 to 0.015N of the solvent in the reaction vessel.

c) The silver nitrate or silver nitrate and halide(s) addition is stopped either before or after the solvent addition. The reaction mixture is held with good stirring for 0.5 to 45 minutes. The bromide concentration is maintained at 0.003N to 0.1N. The temperature can be the same as the nucleation temperature or higher in the range of 35° to 80° C.

d) Most of the basic silver halide solvent is neutralized by addition of acid after the hold time. Additional gelatin generally is added to stabilize the nuclei.

e) Growth of the grain is carried out by adding additional silver nitrate and halide, i.e., bromide and bromoiodide to complete the precipitation growth. This step can have many variations, such as it can be double jet or single jet, or partly double jet and partly single jet. The flow rate can be constant or accelerated. Doping of the emulsion also may be carried out during this growth.

The emulsions of the invention may be used in photographic elements for color negative, color reversal, x-ray films, graphic arts, and instant films.

The process of this invention results in tabular silver halide grains which have a narrow size distribution, less fine grain contamination, and maintain a high aspect ratio, when compared to the known tabular grain processes. The small grain size, high aspect ratio, and narrow size distribution achieved by the invention could not have been predicted from the state of art. The advantages of the invention are achieved by using a hold time after nucleation with a small amount of basic silver solvent, preferably an ammoniacal solvent present during the holding time.

The tabular grain is bromide or bromoiodide. The iodide distribution can vary. The total iodide in the emulsion can be from 0.01 to 25% of the halides. The iodide is preferably between 0.1 and about 12 percent.

In a preferred embodiment during growth after between about 50 and 90 percent of said total silver is precipitated at least 25 percent of the total iodide in said grain is rapidly added. This is commonly called an iodide dump.

The grain of the invention has a thickness of 0.05 to 0.5 μm, and preferably a thickness of 0.05 to 0.2 μm, a grain diameter of 0.2μ to 5 μm, preferable 0.2 to 3 μm, a mean aspect ratio (the aspect ratio is the ratio of the diameter and the thickness) of greater than 2, preferably greater than 5. The diameter is defined as the diameter of a circle having an area equal to the projected area of the grain as viewed in the electron micrograph of an emulsion sample. The thickness is measured by the reflection index of the emulsion. The dispersities of the tabular grain can be described as coefficient of variation (COV), the standard deviation divided by the mean diameter. As shown by the examples and illustrated in FIG. 1 and FIG. 2, the tabular grain prepared by this invention has less fine grain, and the size distribution is narrower than the known method.

Generally the details of the invention process are the following: the reaction vessel can be any conventional vessel for silver halide precipitation equipped with stirring and other control features, such as temperature control. This vessel contains a dispersing medium and halide(s). The halide can be bromide or a bromide-iodide mixture. The total halide concentration is in the range of 0.0075N to 0.6N.

Preferred halide concentration for nucleation is in the range of 0.02N to 0.2N. It is preferred that the halide to be bromide only for nucleation. The halide salt(s) present is typically in the form of aqueous salt solution, such as listed in U.S. Pat. No.4,722,886, col. 3. The dispersing medium is preferred to be gelatin, but it can be other peptizers, such as listed in U.S. Pat. No. 4,722,886.

The temperature of the nucleation step(s) can be from 35° to 80° C. The pH of the solution in the vessel is in the range of 2 to 7. A silver nitrate solution is added into the vessel, or a silver nitrate solution and a halide(s) solution are added into the vessel to form nuclei. In the case both silver and halide(s) are added, the halide concentration can be maintained constant or shifted. The nuclei consist of substantially tabular grain or a mixture of cubic, octohedral, cubooctohedral, and tabular grain.

How much silver is added to form nuclei depends on the final size of the emulsion. Because this invention is the best applied to small grain, the silver used to form nuclei is at least 0.1% by weight of the total silver in the emulsion, and is preferred to be 0.5% and more.

After the formation of nuclei, the temperature of the vessel can be kept unchanged or may raise to a higher temperature. A basic silver halide solvent solution is added to the vessel to achieve about 0.0015N to 0.015N of the solvent in the vessel. The preferred solvent is ammonia or ammonium salt. The ammonium salt is used with the base to release a basic solvent. The ammonium salt is preferred to be ammonium sulfate, and the base is any alkali hydroxide, preferably NaOH or KOH. The ammonium salt solution can be added to the vessel then followed by base solution to release ammonia. Silver nitrate or silver nitrate/halide(s) addition is stopped before or immediately after silver solvent addition. The reaction mixture is held for 0.5 to 45 minutes. The preferred hold time is 0.1 to 15 minutes for the most uniform grains and rapid production. The halide concentration at this step preferred to be at 0.003N to 0.1N, more preferred to be at 0.006 to 0.1N for uniform grains.

After holding the nuclei in the above conditions, the basic solvent present is at least partly neutralized by acid, e.g., nitric acid, sulfuric acid, acetic acid, such that the pH in the reaction vessel is in the range of 2 to 7.5. Additional peptizer can be added at this point to stabilize the nuclei. After this, the growth steps start.

The purpose of the growth steps are to achieve the final size of the tabular grain by adding additional silver nitrate and halide(s) into the reaction vessel. These steps can have many variations, such as they can be double jet or a mix of double jet and single jet. Dopants may be incorporated into the crystal lattice during growth. Dopants include as iridium, selenium, rhodium, and other metals. The flow of silver and halide can be in constant or accelerated rate, or a combination of constant and accelerated rate. Variations in iodide distribution can also be introduced during these steps.

After achieving the final size of the emulsion, the emulsion is washed to remove excess salt. Washing techniques are known to those skilled in the art and include ultrafiltration and desalting by coagulating the emulsion with gelatin.

The emulsions can be chemically and spectrally sensitized to optimum speed, by various methods known to the art, and used as one of the elements in a photographic material, such as a color negative film.

The following examples illustrate the practice of this invention. They are not intended to be exhaustive of all possible variations of the invention. Parts and percentages are by weight unless otherwise indicated. All silver bromoiodide examples produce bromoiodides of a total of 6 mole percent iodide.

EXAMPLE 1

Control: Low Temperature Nucleation Make

Nucleation

In a 4-liter aqueous bone gelatin solution (Solution A, 0.3% gelatin by weight and 0.069 molar NaBr), are added 30 ml of silver nitrate solution (Solution B, 2.75 molar) in 1½ minutes, at 40° C., and at a constant flow rate. Silver nitrate addition is stopped after this time, and the temperature is raised to 60° C. in 10 minutes and maintained at 60° C. the remainder of the precipitation. This segment consumed 0.8% of the total precipitated silver. The reaction vessel comprises 0.054 molar NaBr.

A 4-liter aqueous bone gelatin Solution C (Solution C, 4.4% gelatin by weight) is added to the vessel and stirred for 10 minutes. This is the end of all of the nucleation steps.

Growth

Solution D, (Solution D, 2.63 molar NaBr and 0.081 molar KI) and Solution B are added to the said reaction vessel by double-jet addition utilizing accelerated flow. (10X from start to finish) over 55 minutes at constant pBr 1.89. At 2 minutes before the end of this segment, 0.125 mg of potassium hexachloriri-date(IV) in 0.1N nitric acid is added into the reaction vessel. This segment consumed 75% of the total precipitated silver.

To complete the precipitation, 500 ml of Solution E (Solution E, 2.8 molar NaBr and 0.2 molar KI) and 500 ml of Solution F (Solution F, aqueous 0.56 molar AgI Lippman emulsion) premixed with 0.081 m mole of potassium selenocyanate is dumped into the reaction vessel and stirred for 5 minutes. Solution B is added in constant flow to bring the reaction pBr to 2.4. Then Solution B and Solution G (Solution G, 2.75 molar NaBr) are added in by double jet-method until a total of 10.26 moles of silver is precipitated. This bromoiodide emulsion has a total of 6 mole percent iodide.

The emulsion is cooled down to 40° C. and washed by ultrafiltration to pBr 3.55. Half liter of squeous bone gelatin (50% by weight) is added into the emulsion. A total of 10.26 mole of silver bromoiodide emulsion is precipitated. The emulsion has Equivalent Circular Diameter (ECD) of 0.674 μm and thickness of 0.104 μm (See FIG. 1).

EXAMPLE 2

Control:

The procedure is the same as the control Example 1, except after the temperature rises and before the addition of the extra gelatin, in the nucleation step, the emulsion is held with stirring for 6 minutes. Then extra gelatin is added to the reaction vessel to stabilize the nuclei before the growth steps. The emulsion is found to have an ECD of 0.991 μm and thickness of 0.108 μm. The number of fine grains are less than in Example 1 (see FIG. 1).

EXAMPLE 3

Invention:

The procedure is the same as Example 2, except after the temperature rises, 2.5 g of ammonia sulfate dissolved in 100 ml of water is added into the reaction vessel, followed by adding in 15.18 ml of 2.5N of NaOH to release ammonia. After stirring for 5 minutes, the pH in the reaction vessel is titrated to 5.6 by 6N nitric acid. Additional gelatin is added and growth steps continue. The emulsion has an ECD of 1.05 and average thickness of 0.115 micron. The number of fine grains are less than in Examples 1 and 2, and the tabular grains are smaller.

EXAMPLE 4

Control: Isothermal Make, Nucleation and Growth are at the Same Temperature

The reaction vessel is maintained at 62° C. for the entire run. To a 4-liter aqueous bone gelatin solution (Solution A, 0.3% gelatin by weight and 0.068 molar NaBr), add in 60 ml of silver nitrate solution (Solution B, 2.75 molar) in one minute, and at a constant flow. Silver nitrate addition is stopped. This segment consumes 1.6% of the total precipitated silver. The remaining procedure is similar to Example 1, except the temperature is at 62° C., and the pBr is maintained at 1.95 during the accelerated growth. This procedure makes 10.26 mole of bromoiodide emulsion. The emulsion has ECD 0.522 μm and thickness of 0.106 μm. Electron micrograph also shows many fine grains present in this emulsion (See FIG. 2).

EXAMPLE 5

Control: Isothermal Make

The procedure is like Example 4, except before the addition of the extra gelatin and the growth steps begin, the emulsion is just stirred for 15 minutes. Then the extra gelatin is added to the reaction vessel to stabilize the nuclei. This emulsion has ECD of 0.807 μm and thickness of 0.110 μm. Electron micrograph shows less fine grains present than Example 4 (see FIG. 2) but more than when ammonia is utilized.

EXAMPLE 6

Invention: Isothermal Make

The procedure is like Example 5, except that before additional gelatin is added and growth steps begin, 2.5 g of ammonia sulfate, dissolved in 100 ml of water, is added into the reaction vessel, followed by adding 15.18 ml of 2.5N of NaOH to release ammonia.

After stirring for 15 minutes, the pH in the reaction vessel is titrated to 5.6 by 6N nitric acid. Additional gelatin was added and growth steps continued. The emulsion has an ECD of 0.986 μm and average thickness of 0.122 μm. The electron micrograph showed less fine grains present than in Example 5 (see FIG. 2).

TABLE 1

| LOW TEMPERATURE NUCLEATION | | | | | |
|---|---|---|---|---|---|
| Example | Hold Time After Temp. Rise | Basic Silver Solvent | ECD μm | Thickness μm | Size COV |
| 1 | None | None | 0.674 | 0.104 | 33 |
| 2 | 5 min. | None | 0.991 | 0.108 | 27 |
| 3 | 5 min. | 0.008N* | 1.050 | 0.115 | 23 |

*The concentration of solvent in the reaction vessel

TABLE 2

| ISOTHERMAL MAKE | | | | | |
|---|---|---|---|---|---|
| Example | Hold Time After Ag Nucleation | Basic Silver Solvent | ECD μm | Thickness μm | Size COV |
| 4 | None | None | 0.522 | 0.106 | 30 |
| 5 | 15 min. | None | 0.807 | 0.110 | 30 |
| 6 | 15 min. | 0.008N* | 0.986 | 0.121 | 24 |

*The concentration of solvent in the reaction vessel

Figure 1:
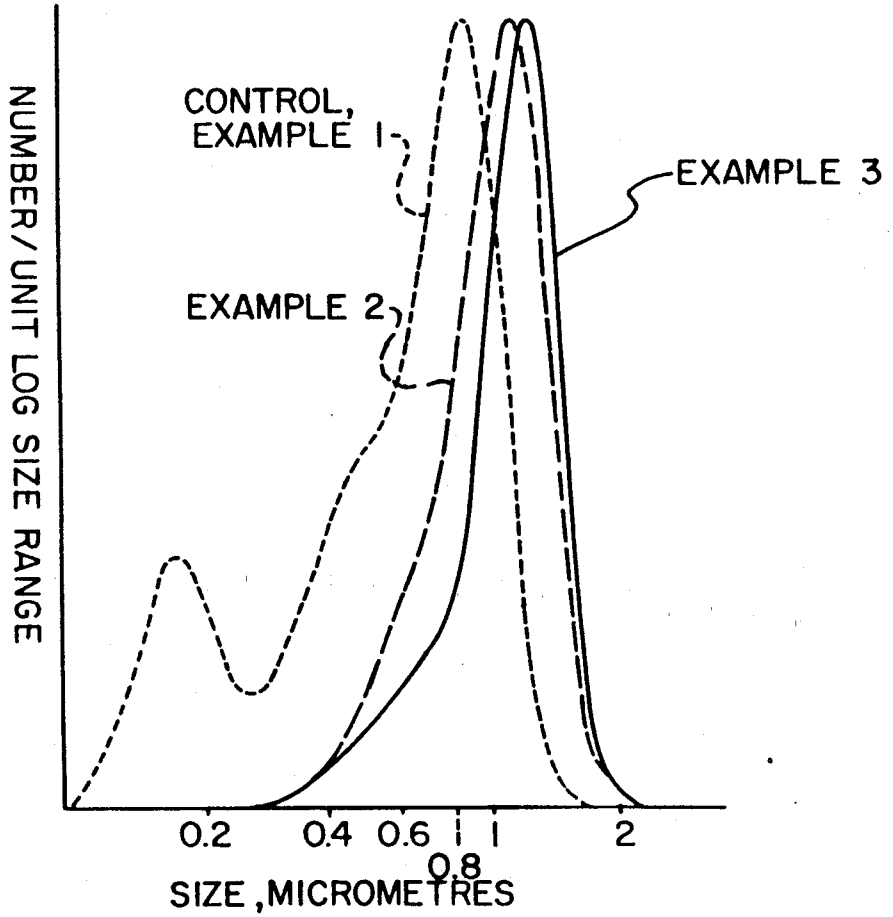
FIG. 1 illustrates the size and number distribution of grains produced in Examples 1–3.

The comparisons of Table 1 and Table 2 make clear that the invention Examples 3 and 6 result in a lower coefficient of variation than when the ammoniacal silver solver in the invention concentration is not utilized. The particle sizing in FIG. 1 and FIG. 2 is by electron micrograph, and the graphing is by number distribution. Examples of FIG. 1 are with low temperature nucleating and FIG. 2 the examples of an isothermal make.

The invention has been described in detail with particular reference to preferred embodiments thereof, but it will be understood that variations and modifications can be effected within the spirit and scope of the invention.

I claim:

1. A method of forming small narrow size distribution silver bromide of bromoiodide grains having coefficients of variation of less than 25. grain thickness of 0.05 to 0.5. mean aspect ratio of greater than 2. and equivalent circular diameters of 0.2 to 3 micron.

comprising digesting nucleated grains in a basic silver halide solvent having a concentration of between about 0.0015 and about 0.015N and neutralizing said basic solvent after said digesting and prior to growth.

2. The method of claim 1 wherein the said nucleated grains are formed from a bromide solution having a bromide ion concentration of between about 0.0075 and about 0.6N.

3. The method of claim 1 wherein said nucleated grains are formed by the combination of an aqueous solution comprising silver ions and an aqueous solution comprising bromide ions at a bromide concentration of between 0.0075 and 0.6N.

4. The method of claim 1 wherein said nucleated grains are digested for 0.5 to about 45 minutes at a bromide ion concentration of 0.003 to 0.1N prior to growth.

5. The method of claim 1 wherein said basic solvent comprises ammonia and the temperature during digestion is the same or higher than the temperature during nucleation.

6. The method of claim 5 wherein the temperature during nucleation is between about 35° and 80° C.

7. The method of claim 1 wherein after said digesting said grains are then grown to said equivalent circular diameter of about 0.2 to about 3.0 micron.

8. The method of claim 1 wherein the aspect ratio of said grains is greater than 5.

9. A method of forming silver halide grains having an equivalent circular diameter of about 0.2 to about 3.0 micron and an average thickness between about 0.05 and about 0.5 microns, and aspect ratio greater than 5 comprising combining a silver ion source and a source of halide ions to nucleate silver halide particles at a bromide ion concentration of 0.0075 to 0.6N, digesting said nucleated grains at a basic halide solvent concentration of between about 0.0015 and about 0.015N, neutralizing at least part of said basic solvent, and then growing said grains to the desired size.

10. The method of claim 9 wherein said basic solvent comprises ammonium hydroxide.

11. The method of claim 10 wherein the temperature during digestion is the same or higher than during nucleation.

12. The method of claim 11 wherein the coefficient of variation of said emulsion is less than about 25.

13. The method of claim 12 wherein said digesting is carried out for between about 1 and about 15 minutes.

14. The method of claim 12 wherein said grains produced by the method are between about 0.05 and 0.2 micron in thickness.

15. The method of claim 9 wherein said digesting is for between about 0.5 and about 45 minutes.

16. The method of claim 9 wherein said silver halide comprises bromoiodide, and after between 50 and 90 percent of the total silver is precipitated, there is rapidly added at least 25 percent of the total iodide to be precipitated.

17. The method of claim 9 wherein said neutralizing of at least part of said basic solvent results in a pH in the reaction vessel in the range of 2 to 7.5.

* * * * *

UNITED STATES PATENT AND TRADEMARK OFFICE

CERTIFICATE OF CORRECTION

PATENT NO. : 5,254,453

DATED : October 19, 1993

INVENTOR(S) : E.P. Chang

It is certified that error appears in the above-indentified patent and that said Letters Patent is hereby corrected as shown below:

On the title page, item (75) delete "Elizabeth U. Chang" and insert --Elizabeth P. Chang--.

Signed and Sealed this

Fifth Day of April, 1994

Bruce Lehman

*Attest:*

BRUCE LEHMAN

*Attesting Officer*

*Commissioner of Patents and Trademarks*